US012780588B2

(12) United States Patent
Sahin et al.

(10) Patent No.: US 12,780,588 B2
(45) Date of Patent: Nov. 3, 2026

(54) PACKAGE CUTTING MACHINE WHICH ENABLES CUTTING FROM BROAD PACKAGE BOBBINS

(71) Applicant: Mondi Kale Nobel Ambalaj Sanayi Ve Ticaret Anonim Sirketi, Bakirkoy (TR)

(72) Inventors: Umit Sahin, Luleburgaz (TR); Mehmet Ulas Ipek, Bakirkoy (TR)

( * ) Notice: Subject to any disclaimer, the term of this patent is extended or adjusted under 35 U.S.C. 154(b) by 215 days.

(21) Appl. No.: 18/849,835

(22) PCT Filed: Aug. 2, 2022

(86) PCT No.: PCT/TR2022/050811

§ 371 (c)(1),
(2) Date: Sep. 23, 2024

(87) PCT Pub. No.: WO2023/195944

PCT Pub. Date: Oct. 12, 2023

(65) Prior Publication Data

US 2025/0197156 A1 Jun. 19, 2025

(30) Foreign Application Priority Data

Apr. 8, 2022 (TR) ..... 2022/005640

(51) Int. Cl.
*B65H 35/06* (2006.01)
*B65H 23/04* (2006.01)

(52) U.S. Cl.
CPC ..... *B65H 35/06* (2013.01); *B65H 23/044* (2013.01); *B65H 23/048* (2013.01); *B65H 2301/5153* (2013.01); *B65H 2701/1944* (2013.01)

(58) Field of Classification Search
CPC .... B65H 35/06; B65H 23/044; B65H 23/048; B65H 2301/5153; B65H 2701/1944
See application file for complete search history.

(56) References Cited

U.S. PATENT DOCUMENTS

| | | | |
|---|---|---|---|
| 4,680,023 | A | 7/1987 | Varano |
| 4,856,392 | A | 8/1989 | Appelberg |
| 2003/0197298 | A1 | 10/2003 | Hegishi |

FOREIGN PATENT DOCUMENTS

| | | | |
|---|---|---|---|
| CN | 201670615 U | | 12/2010 |
| CN | 103625974 A | * | 3/2014 |
| CN | 103692694 A | | 4/2014 |
| CN | 203766108 U | | 8/2014 |

OTHER PUBLICATIONS

Machine Translation CN 103625974 A (Year: 2014).*
International Search Report for corresponding PCT/TR2022/050811 dated Nov. 17, 2022.
Written Opinion of the International Searching Authority for corresponding PCT/TR2022/050811 dated Nov. 17, 2022.
Extended European Search Report for EP Application No. 22936675, dated Mar. 11, 2026.

* cited by examiner

*Primary Examiner* — Eronica Martin
(74) *Attorney, Agent, or Firm* — Egbert, McDaniel & Swartz, PLLC

(57) ABSTRACT

Disclosed is a package cutting machine used in the production of products produced by being crimped such as cornet cone packages, paper cups, paper buckets, etc.

10 Claims, 2 Drawing Sheets

PACKAGE CUTTING MACHINE WHICH ENABLES CUTTING FROM BROAD PACKAGE BOBBINS

TECHNICAL FIELD

Figure 1:
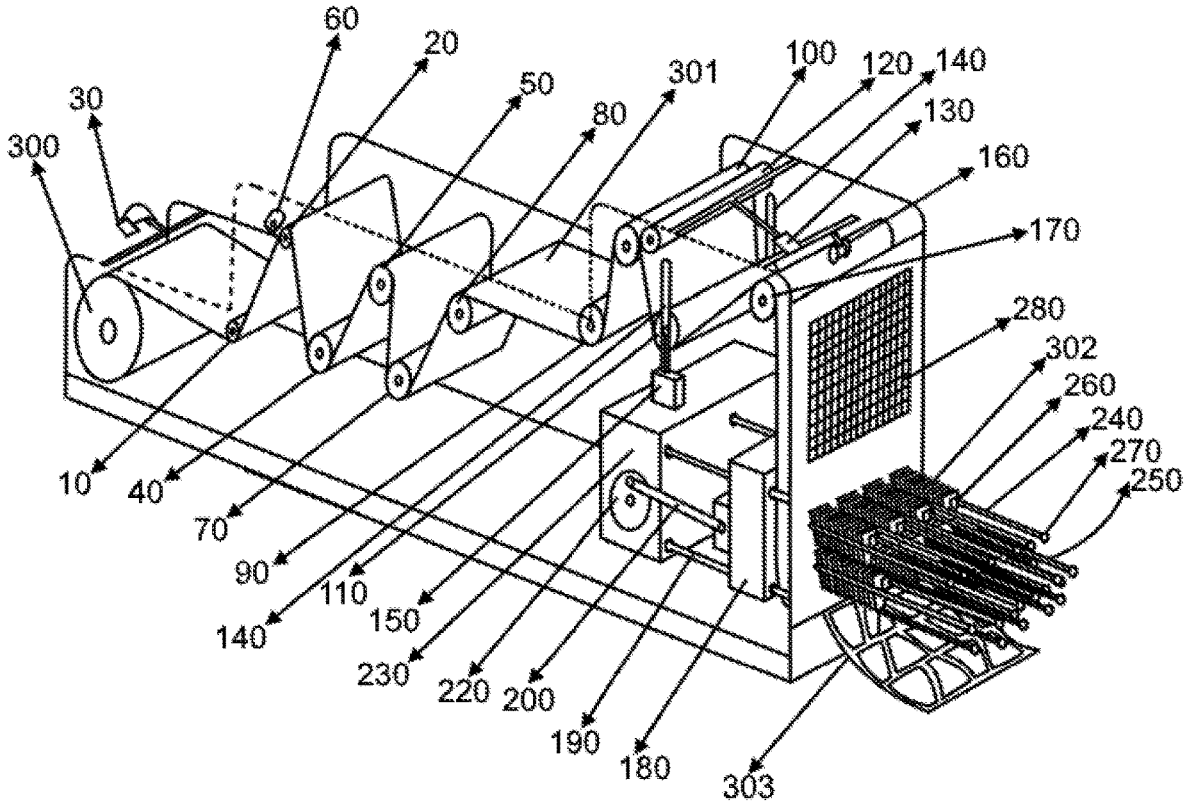

The invention is related to a package cutting machine used in the production of products produced by being crimped such as cornet cone packages, paper cups, paper buckets, etc.

The invention is particularly related to a package cutting machine which provides for producing more package slices at a time by cutting broad sized package bobbins, thereby increasing the production capacity and that the cutting is done properly by preventing the folding and slipping of the package during the cutting.

PRIOR ART

The products produced by being crimped such as cornet cone packages, paper cups, paper buckets, etc. are cut by giving the same special shapes in package cutting machines first and then shaped by crimping the specifically shaped package slices.

In the package cutting machines used in the art, package bobbins having a narrow structure are used and specially formed package slices are cut from said narrow package bobbins. The production is limited because of the narrow structure of the package bobbins and the number of cutting machines needs to be increased in order to improve the production capacity. This requires considerable investments and additional space in the production area and increases the energy and labor expenditures. In addition to the mentioned disadvantages, the cutting procedure may not be carried out properly due to reasons such as the folding or slipping of the package in the present cutting machines. This causes wastage and production costs to increase. Therefore, in the known state of the art, there is a need for a machine which makes proper cuts from broad sized package bobbins.

In consequence, the presence of the above-mentioned problems and the inefficiency of the present solutions requires a development in the related technical field.

PURPOSE OF THE INVENTION

The present invention is related to a cutting machine which enables cutting from broad package bobbins, eliminates the above-mentioned disadvantages, and brings new advantages to the related technical field.

The main purpose of the invention is to present a package cutting machine which provides for producing more package slices at a time by cutting broad sized package bobbins and thereby increasing the production capacity.

The purpose of the invention is to present a package cutting machine which prevents the folding and slipping of the package bobbins during cutting with opening and stretching procedures and provides for the cutting to be done properly.

In order to fulfill the above-mentioned purposes and the ones that can be inferred from the detailed description, the invention is a package cutting machine used in the production of products produced by being crimped such as cornet cone packages, paper cups, paper buckets, etc., comprising

- a lower opening cylinder and an upper opening cylinder which opens the package from the package bobbin,

- a lower stretching cylinder which passes the package opened from the package bobbin from under and stretches the same,
- an upper stretching cylinder which passes the package from the lower stretching cylinder from above and stretches the same,
- a lower straightening cylinder which passes the package from the upper stretching cylinder from under and straightens the same,
- an upper straightening cylinder which passes the package from the lower straightening cylinder from under and straightens the same,
- a final straightening cylinder which passes the package from the upper straightening cylinder flat from under and straightens the same,
- a flattening cylinder which flattens the package passing from the final straightening cylinder,
- a dynamic cylinder which moves up and down, providing that the packages from the flattening cylinder are transferred at certain intervals,
- a compression cylinder which is positioned inwards on the dynamic cylinder, which presses the package from the dynamic cylinder and prevents the same from rising and provides that it remains stretched,
- a final feeding cylinder which transfers the package passing from the dynamic cylinder,
- a slicing press with back-and-forth motion which cuts the package transferred from the final feeding cylinder and turns it into a specially formed package slice,
- a press guide bearing the back-and-forth motion of the slicing press,
- a dynamic press movement arm with back-and-forth motion which is connected to the slicing press, and which moves the slicing press back and forth on the press guide,
- a rotational disk which is connected at the end of the press movement arm, and which has a rotational movement,
- a press motor which rotates the rotational disk in order to drive the press movement arm,
- a side package holder and a lower package holder which are located at the rear side of the slicing press, and which hold and stack the specially formed package slices obtained on the slicing press.

The structural and characteristic features and all the advantages of the invention will be understood more clearly thanks to the figures given below and the detailed description written by making references to these figures. Therefore, the evaluation should be made in consideration of these figures and the detailed description.

FIGURES AIDING THE DESCRIPTION OF THE INVENTION

FIG. 1: Representative view of the cutting machine of the invention.

Figure 2:
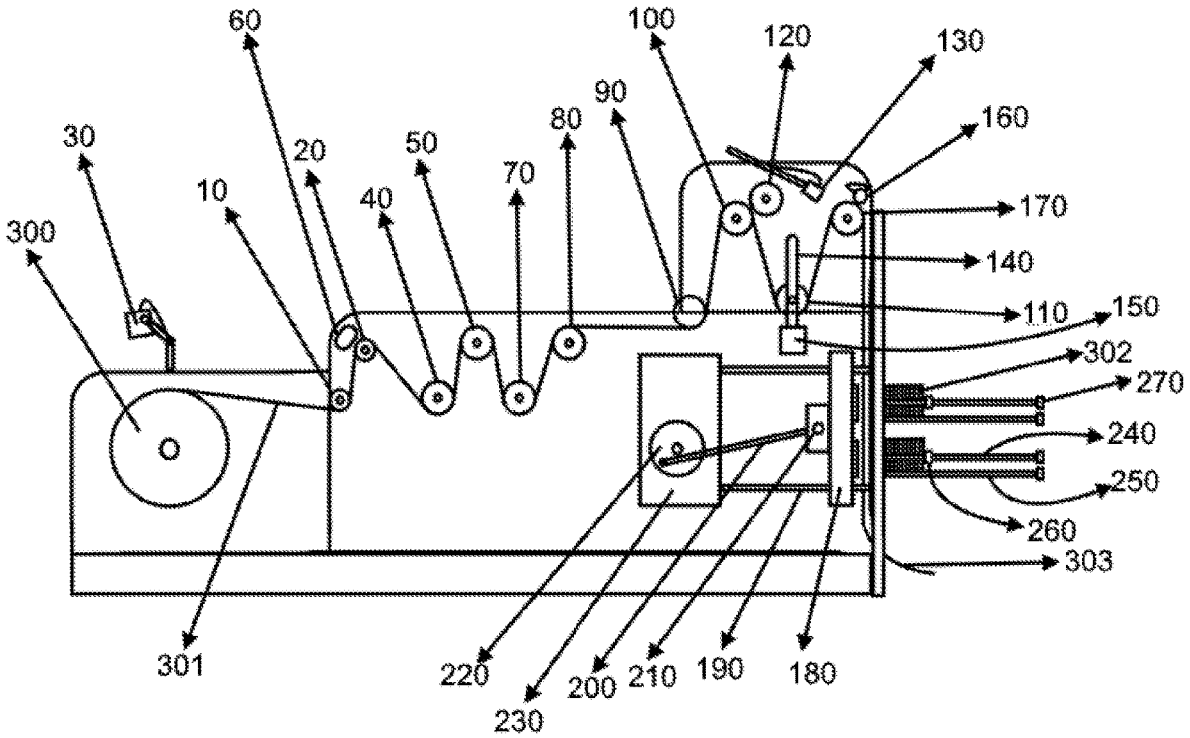

FIG. 2: Side view of the cutting machine of the invention.

DESCRIPTION OF THE REFERENCE PARTS

10. Lower opening cylinder
20. Upper opening cylinder
30. Bobbin sensor
40. Lower stretching cylinder
50. Upper stretching cylinder
60. Edge control sensor
70. Lower straightening cylinder
80. Upper straightening cylinder

90. Final straightening cylinder
100. Flattening cylinder
110. Dynamic cylinder
120. Compression cylinder
130. Stretcher sensor
140. Cylinder rail
150. Movement piston
160. Flatness sensor
170. Final feeding cylinder
180. Slicing press
190. Press guide
200. Press movement arm
210. Press movement joint
220. Rotational disk
230. Press motor
240. Side package holder
250. Lower package holder
260. Package compressor
270. Package slice stop
280. Wire grid
300. Package bobbin
301. Stretched package
302. Specially cut package slice
303. Waste package

DETAILED DESCRIPTION OF THE INVENTION

In this detailed description the preferred alternatives of the package cutting machine of the invention are described only for a better understanding of the subject and in the way to create no limiting effect whatsoever.

In FIG. 1, representative view of the package cutting machine of the invention has been given. Accordingly, the package cutting machine basically comprises a lower opening cylinder (10) and an upper opening cylinder (20) which opens the package from the package bobbin (300), a bobbin sensor (30) which adjusts the opening speed of the package bobbin (300), a lower stretching cylinder (40) which passes the package opened from the package bobbin (10) from under and stretches the same, an upper stretching cylinder (50) which passes the package opened from the lower stretching cylinder (40) from above and stretches the same, a lower straightening cylinder (70) which passes the package from the upper stretching cylinder (50) from under and straightens the same, an upper straightening cylinder (80) which passes the package from the lower straightening cylinder (70) from under and straightens the same, a final straightening cylinder (90) which passes the package from the upper straightening cylinder (80) flat from under and straightens the same, a flattening cylinder (100) which flattens the package passing from the final straightening cylinder (90), a dynamic cylinder (110) which moves up and down, providing that the packages from the flattening cylinder (100) are transferred at certain intervals, a compression cylinder (120) which presses the package from the dynamic cylinder (110) and prevents the same from rising and provides that it remains stretched, a stretcher sensor (130) which measures the stretch of the package passing from the compression cylinder (120), a final feeding cylinder (170) which transfers the package passing from the dynamic cylinder (110), a flatness sensor (160) which controls the flatness of the package passing from the final feeding cylinder (170), a slicing press (180) with back-and-forth motion which cuts the package transferred from the final feeding cylinder (170) and turns it into specially formed package slice (302), a press guide (190) bearing the back-and-forth motion of the slicing press (180), a press movement arm (200) which is connected to the slicing press (180) by means of the press movement joint (210) and moves the slicing press (180) back and forth on the press guide (190), a press motor (230) which is connected to the press movement arm (200) by means of the rotational disk (220) and which drives the press movement arm (200) with the rotational movement, a side package holder (240) and a lower package holder (250) which hold and stack the specially formed package slices (302) obtained on the slicing press (180), a package compressor (260) which press the specially formed package slices (302) on the side package holder (240) and the lower package holder (250), a package slice stop (270) which prevents the specially formed package slices (302) from bulging out over the side package holder (240) and lower package holder (250), and a wire grid (280) which provides that the package descending to the slicing press (180) from the final feeding cylinder (170) is observed.

The package cutting machine according to the invention provides for the production of specially cut package slices (302) with a cutting procedure from the package bobbin (300). As seen in FIG. 2, the package on the package bobbin (300) connected to the package cutting machine is separated and opened from the package bobbin (300) by means of the lower opening cylinder (10), and the first stretch is provided by means of the upper opening cylinder (20). On the upper opening cylinder (20), there is at least one bobbin sensor (30). The bobbin sensor (30) adjusts the opening speed of the package bobbin (300) depending on the diameter of the package bobbin (300).

The package from the lower stretching cylinder (40) is passed over the upper stretching cylinder (50) and passed under the lower straightening cylinder (70) and is transferred to the upper straightening cylinder (80). There is an edge control sensor (60) which controls the edges of the package on the upper stretching cylinder (50). The stretched package (301) from the upper straightening cylinder (80) is transferred to the flattening cylinder (100) with the final straightening cylinder (90). The package from the flattening cylinder (100) arrives at the dynamic cylinder (110) which moves up and down. The dynamic cylinder (110) provides that the continuous package transfer is carried out for slicing at certain intervals. For this purpose, the dynamic cylinder (110) moves up and down by means of a movement piston (150) on a cylinder rail (140). The dynamic cylinder (110) is connected on said cylinder rail (140) and the movement piston (150) moves the cylinder rail (140) up and down.

An inward compression cylinder (120) is positioned on the dynamic cylinder (110). Said compression cylinder (120) presses the package passing through the dynamic cylinder (110) and prevents it from rising, providing that it remains stretched. The stretch of the package passing from the compression cylinder (120) is measured by means of the stretcher sensor (130) positioned on the compression cylinder (120).

Passing from the dynamic cylinder (110), the package is transferred to the slicing press (180) by means of the final feeding cylinder (170). Descending from the final feeding cylinder (170) to the slicing press (180), the package can be observed from the wire grid (280) located between the final feeding cylinder (170) and the slicing press (180).

The flatness of the package passing from the final feeding cylinder (170) is controlled by means of the flatness sensor (160) positioned on the final feeding cylinder (170).

The slicing press (180) with back-and-forth motion cutting the package transferred from the feeding cylinder (170) and turning the same into a specially formed package slice (302) is carried on the press guide (190) and its back-and-forth motion on said press guide (190) is provided.

For the back-and-forth motion of the slicing press (180), a press movement arm (200) is connected to the slicing press (180) by means of the press movement joint (210). Said press movement arm (200) is connected on the other end to the distal point from the rotational disk (220) on a press motor (230) which makes a rotational movement. Thereby, it is provided that the rotational disk (220) rotates with the rotational movement of the press motor (230) and makes a back-and-forth motion with the press movement arm (200) being driven.

The specially formed package slices (302) obtained on the slicing press (180) are stacked by being held by means of the side package holder (240) and lower package holder (250) located at the rear side of the slicing press (180). In the meantime, the waste packages (303) from the specially cut package slices (302) are transferred out from the package cutting machine in order to be reused.

There is a package compressor (260) on the side package holder (240) and the lower package holder (250). Said package compressor (260) presses the specially formed package slices (302) on the side package holder (240) and lower package holder (250). At the same time, there is a package slice stop (270) on the side package holder (240) and the lower package holder (250). Said package slice stop (270) prevents the specially formed package slices (302) from bulging out over the side package holder (240) and lower package holder (250). The specially formed package slices (302) stacked on the side package holder (240) and lower package holder (250) are held in order with the package compressor (260) and stacked to the package slice stop (270).

The working principle of the package cutting machine according to the invention is as follows;

The package on the package bobbin (300) connected to the package cutting machine is separated and opened from the package bobbin (300) by means of the lower opening cylinder (10) and the first stretch is provided by means of the upper opening cylinder (20).

The package from the lower stretching cylinder (40) is passed over the upper stretching cylinder (50) and passed under the lower straightening cylinder (70) and the stretched package (301) which is passed from the upper straightening cylinder (80) is transferred to the flattening cylinder (100) with the final straightening cylinder (90). Arriving from the flattening cylinder (100), the package is transferred to the slicing press (180) by means of the final feeding cylinder (170) by leaving a margin for the package in the dynamic cylinder (110) and cut into a specially formed package slice (302).

The specially formed package slices (302) obtained on the slicing press (180) are stacked by being held by means of the side package holder (240) and lower package holder (250) located at the rear side of the slicing press (180). The specially formed package slices (302) stacked on the side package holder (240) and lower package holder (250) are held in order with the package compressor (260) and stacked to the package slice stop (270). The waste packages (303) left from the specially cut package slices (302) are transferred out in order to be reused.

The invention claimed is:

1. A package cutting machine for producing crimped products, the package cutting machine comprising:

a lower opening cylinder;

an upper opening cylinder cooperative with said lower opening cylinder and adapted to open a package from a package bobbin;

a lower stretching cylinder adapted to pass the opened package from beneath the opened package and to stretch the opened package;

an upper stretching cylinder cooperative with said lower stretching cylinder and adapted to pass the opened package from above the opened package and to stretch the opened package;

a lower straightening cylinder cooperative with said an upper stretching cylinder and adapted to pass the opened package from below and to straighten the opened package;

an upper straightening cylinder cooperative with said lower stretching cylinder and adapted to pass the opened package from below and to straighten the opened package;

a final straightening cylinder cooperative with said upper straightening cylinder and adapted to pass the opened package from below and to further straighten the opened package;

a flattening cylinder cooperative with said final straightening cylinder and adapted to flatten the opened package;

a dynamic cylinder that is movable upwardly and downwardly and adapted to transfer the opened package from said flattening cylinder at intervals;

a compression cylinder positioned inwardly on said dynamic cylinder, said compression cylinder adapted to press the opened package from said dynamic cylinder such that the opened package remains stretched and is prevented from rising;

a final feeding cylinder cooperative with said dynamic cylinder, said final feeding cylinder adapted to transfer the opened package from said dynamic cylinder;

a slicing press having a back-and-forth motion, said slicing press adapted to cut the opened package transferred from said final feeding cylinder so as to form a package slice;

a press guide bearing the back-and-forth motion of said slicing press;

a dynamic press movement arm having a back-and-forth motion, said dynamic press movement arm being connected to the slicing press so as to move said slicing press back-and-forth on said press guide;

a rotational disk connected to an end of said dynamic press movement arm, said rotational disk having a rotational movement;

a press motor rotating said rotational disk so as to drive said dynamic press movement arm;

a side package holder; and a lower package holder, said side package holder and said lower package holder positioned at a rear side of said slicing press, said side package holder being cooperative with and adapted to hold and stack the package slice from said slicing press.

2. The package cutting machine of claim 1, further comprising:

a bobbin sensor positioned on said upper opening cylinder, said bobbin sensor adapted to adjust a speed of the package bobbin.

3. The package cutting machine of claim 1, further comprising:

an edge control sensor positioned on said upper stretching cylinder, said edge control sensor adapted to control an edge of the opened package.

4. The package cutting machine of claim 1, further comprising:

a stretcher sensor cooperative with said compression cylinder and adapted to measure a stretch of the opened package from said compression cylinder.

5. The package cutting machine of claim 1, further comprising:

a flatness sensor positioned on said final feeding cylinder, said flatness sensor adapted to control a flatness of the opened package from said final feeding cylinder.

6. The package cutting machine of claim 1, further comprising:

a cylinder rail connected to said dynamic cylinder so as to provide upward and downward movement of said dynamic cylinder by a movement piston.

7. The package cutting machine of claim 1, further comprising:

a press movement joint connecting said dynamic press movement arm to said slicing press.

8. The package cutting machine of claim 1, further comprising:

a package compressor positioned at a side of said side package holder and said lower package holder, said package compressor adapted to press the package slice on said side package holder and said lower package holder.

9. The package cutting machine of claim 1, further comprising:

a package slice stop positioned on said side package holder and said lower package holder, said package slice stop adapted to prevent the package slice from bulging out over said side package holder and said lower package holder.

10. The package cutting machine of claim 1, further comprising:

a wire grid positioned between said final feeding cylinder and said slicing press, said wire grid adapted to allow for an observation of the opened package descending from said final feeding cylinder to said slicing press.

* * * * *